US008434852B2

(12) United States Patent
Hagiwara

(10) Patent No.: US 8,434,852 B2
(45) Date of Patent: May 7, 2013

(54) LIQUID EJECTING HEAD UNIT AND LIQUID EJECTING APPARATUS

(75) Inventor: Hiroyuki Hagiwara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 54 days.

(21) Appl. No.: 13/151,887

(22) Filed: Jun. 2, 2011

(65) Prior Publication Data

US 2012/0007911 A1 Jan. 12, 2012

(30) Foreign Application Priority Data

Jul. 9, 2010 (JP) ..... 2010-156409

(51) Int. Cl.
*B41J 2/015* (2006.01)

(52) U.S. Cl.
USPC ..... 347/20

(58) Field of Classification Search ..... 347/20, 347/40, 44, 85
See application file for complete search history.

(56) References Cited

U.S. PATENT DOCUMENTS 7,731,333 B2 * 6/2010 Honma et al. ..... 347/47

FOREIGN PATENT DOCUMENTS

JP 2008-273109 11/2008

* cited by examiner

*Primary Examiner* — An Do
(74) *Attorney, Agent, or Firm* — Workman Nydegger

(57) ABSTRACT

Provided is a liquid ejecting head unit including: a liquid ejecting head which includes a nozzle ejecting a liquid; and a head fixing member to which a plurality of the liquid ejecting heads is positioned and fixed, wherein the head fixing member includes a head holding unit to which the liquid ejecting head is fixed and a body to which the head holding unit is fixed, and wherein the rigidity of the body is lower than that of the head holding unit and the specific weight of the body is smaller than that of the head holding unit.

7 Claims, 16 Drawing Sheets

LIQUID EJECTING HEAD UNIT AND LIQUID EJECTING APPARATUS

The entire disclosure of Japanese Patent Application No: 2010-156409, filed Jul. 9, 2010 are expressly incorporated by reference herein.

BACKGROUND

1. Technical Field

The present invention relates to a liquid ejecting head unit used in a liquid ejecting apparatus such as an ink jet recording apparatus and a liquid ejecting apparatus having the same, and particularly, to a liquid ejecting head unit capable of attaching a plurality of liquid ejecting heads with high precision and a liquid ejecting apparatus having the same.

2. Related Art

A liquid ejecting apparatus is an apparatus that includes a liquid ejecting head capable of ejecting a liquid in the form of a liquid droplet and ejects various liquids from the liquid ejecting head. A representative example of the liquid ejecting apparatus includes an image recording apparatus such as an ink jet recording apparatus (a printer) that includes an ink jet recording head (hereinafter, referred to as a recording head) and performs a recording operation by ejecting a liquid-like ink from a nozzle of the recording head in the form of ink droplets. Further, in recent years, the liquid ejecting apparatus has been applied not only to image recording apparatuses, but also to various manufacturing apparatuses such as a display manufacturing apparatus.

Recently, a printer has been introduced which includes a single head unit configured by arranging and fixing a plurality of recording heads, each having a nozzle group with a plurality of nozzles arranged in parallel, to a head fixing member such as a sub-carriage (for example, refer to JP-A-2008-273109). The sub-carriage is a frame-like flat plate member of which a portion that is attached to the plurality of recording heads is opened, and is made of a synthetic resin for weight reduction. Each recording head is screw-fixed to the sub-carriage while being positioned with respect thereto.

However, a rotational moment generated when the recording head is firmly screw-fixed to the sub-carriage may be exerted on the sub-carriage, such that there is a possibility that the frame-like sub-carriage may be deformed. Particularly when the plurality of recording heads is sequentially attached to the sub-carriage, the sub-carriage may be further deformed to the degree to which recording heads are fixed since the rotational moment is exerted on the sub-carriage when each recording head is fixed thereto. Further, even when the recording head is attached and fixed through position adjustment, the sub-carriage is deformed by the rotational moment generated when the attached recording head is fixed, such that its position is deviated from its originally set position. Further, due to the accumulation of the deformation of the sub-carriage, the relative position between the recording heads, and further, the relative position between the nozzles of the recording heads are deviated. As a result, there is a concern that the image quality of a recorded image or the like may be degraded due to a deviation in the impact position of the ink with respect to a recording medium.

In order to prevent such problems, a technique may be considered in which the entire sub-carriage is made of a highly rigid material, for example, metal such as stainless steel or aluminum. However, in this case, the weight of the entire head unit increases. Corresponding to this increase in weight, in printers equipped with the head unit, there is a need to further increase the size of the motor for moving the head in order to move the head unit smoothly. As a result, there are problems in that the entire printer increases in size and due to this the cost thereof increases.

Furthermore, these problems are present not only in ink jet recording apparatuses equipped with the recording head ejecting ink, but also other liquid ejecting head units adopting a configuration in which a plurality of liquid ejecting heads is fixed to a frame-like head fixing member such as a sub-carriage and a liquid ejecting apparatus including the same.

SUMMARY

An advantage of some aspects of the invention is that it provides a liquid ejecting head unit capable of simultaneously improving positioning precision of a liquid ejecting head and decreasing the weight of a head fixing member and a liquid ejecting apparatus including the liquid ejecting head unit.

According to an aspect of the invention, there is provided a liquid ejecting head unit including: a liquid ejecting head which includes a nozzle ejecting a liquid; and a head fixing member to which a plurality of the liquid ejecting heads is positioned and fixed, wherein the head fixing member includes a head holding unit to which the liquid ejecting head is fixed and a body to which the head holding unit is fixed, and wherein the rigidity of the body is lower than that of the head holding unit and the specific weight of the body is smaller than that of the head holding unit.

According to the aspect, the head fixing member includes the head holding unit and the body, the rigidity of the head holding unit which is attached to the liquid ejecting head, is set to be comparatively high, and the rigidity of the body is set to be lower than that of the head fixing member. Therefore, it is possible to simultaneously improve the positioning precision of each liquid ejecting head fixed to the head holding unit and decrease the weight of the head fixing member. That is, since the rigidity of the head holding unit is higher than that of the body, when the liquid ejecting head is fixed to (specifically, screw-fixed to) the head holding unit, the deformation of the head holding unit may be suppressed and the deviation of the relative position of the liquid ejecting heads fixed to the head holding unit may be suppressed. As a result, the positioning precision of each nozzle in the liquid ejecting head unit improves. Further, since the specific weight of the body is smaller than that of the head holding unit, the weight of the head fixing member may be decreased. Accordingly, the motor as a driving source used for moving the liquid ejecting head unit may be decreased in size, the apparatus may be decreased in size, and costs may be reduced.

In the above-described configuration, the head holding unit and the body may be positioned with respect to each other by fitting a positioning pin provided in one of them into a positioning hole provided in the other thereof.

Further, in the above-described configuration, a passage member having a passage provided therein to supply the liquid to the liquid ejecting head may be fixed to the body.

According to this configuration, since the passage member is fixed to the body, a rotational moment generated when screw-fixing the passage member into the body barely affects the head holding unit. As a result, the relative positions of the liquid ejecting heads fixed to the head holding unit are barely deviated from each other.

In this configuration, the passage member may include a passage positioning hole corresponding to the positioning pin, and may be positioned to the body by fitting the positioning pin into the passage positioning hole.

According to the above-described configuration, since the passage member and the head holding unit are positioned with respect to the body by using the common positioning pin, the relative position of the head holding unit and the passage member attached to the body may be defined with high precision. Accordingly, the deviation of the relative position therebetween is suppressed, and stress between the passage member and the head holding unit due to positional deviation may be prevented. As a result, deterioration in the positioning precision of each liquid ejecting head of the head holding unit may be suppressed.

In the above-described configuration, the liquid ejecting head unit may further include a fixing unit which fixes the head holding unit to the body, and the fixing unit may be screw-fixed to the body with the head holding unit interposed between the body and the fixing unit.

According to the above-described configuration, since the fixing unit is screw-fixed to the body with the head holding unit interposed between the body and the fixing unit, the rotational moment generated when fastening the screw barely affects the head holding unit. As a result, the deviation of the liquid ejecting heads fixed to the head holding unit may be more effectively suppressed.

Further, according to another aspect of the invention, there is provided a liquid ejecting apparatus including: a liquid ejecting head unit which includes a liquid ejecting head including a nozzle ejecting a liquid and a head fixing member allowing a plurality of the liquid ejecting heads to be positioned and fixed thereto, wherein the head fixing member includes a head holding unit to which the liquid ejecting head is fixed and a body to which the head holding unit is fixed, and wherein the rigidity of the body is lower than that of the head holding unit and the specific weight of the body is smaller than that of the head holding unit.

According to the aspect, the head fixing member includes the head holding unit and the body, the rigidity of the head holding unit which is attached to the liquid ejecting head is set to be comparatively high, and the rigidity of the body is set to be lower than that of the head fixing member. Therefore, it is possible to simultaneously improve the positioning precision of each liquid ejecting head and decrease the weight of the head fixing member. That is, since the rigidity of the head holding unit is higher than that of the body, when the liquid ejecting head is fixed to (specifically, screw-fixed to) the head holding unit, the deformation of the head holding unit may be suppressed and the deviation of the relative position of the liquid ejecting heads fixed to the head holding unit may be suppressed. Further, since the specific weight of the body is smaller than that of the head holding unit, the weight of the head fixing member may be decreased. Accordingly, the motor as a driving source used for moving the liquid ejecting head unit may be decreased in size, the apparatus may be decreased in size, and costs may be reduced.

In the above-described configuration, the liquid ejecting apparatus may further include: a unit holding unit which holds the liquid ejecting head unit, wherein the body of the head fixing member of the liquid ejecting head unit may be fixed to the unit holding unit with a position adjusting mechanism capable of adjusting the disposition position of the liquid ejecting head unit with respect to the unit holding unit interposed therebetween, and wherein the head holding unit of the head fixing member may be detachably fixed to the body while the body is fixed to the unit holding unit.

According to the above-described configuration, the body of the head fixing member is fixed to the unit holding unit with the position adjusting mechanism capable of adjusting the disposition position of the liquid ejecting head unit with respect to the unit holding unit interposed therebetween, and the head holding unit of the head fixing member is detachably fixed to the body while the body is fixed to the unit holding unit. Therefore, replacement or maintenance of each liquid ejecting head fixed to the head holding unit may be facilitated. Further, all liquid ejecting heads may be replaced for each head holding unit. Further, a posture such as a position or an inclination of the liquid ejecting head unit with respect to the unit holding unit may be easily adjusted again by the position adjusting mechanism after replacement or maintenance.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described by referring to the accompanying drawings. Furthermore, in the embodiments to be described below, the invention is exemplified as various specific examples suitable for the invention, however the scope of the invention is not limited to the embodiments where no special remark for limiting the invention is made in the description below. Further, in the description below, an ink jet recording apparatus (hereinafter, a printer) will be exemplified as a liquid ejecting apparatus of the invention.

Figure 1:
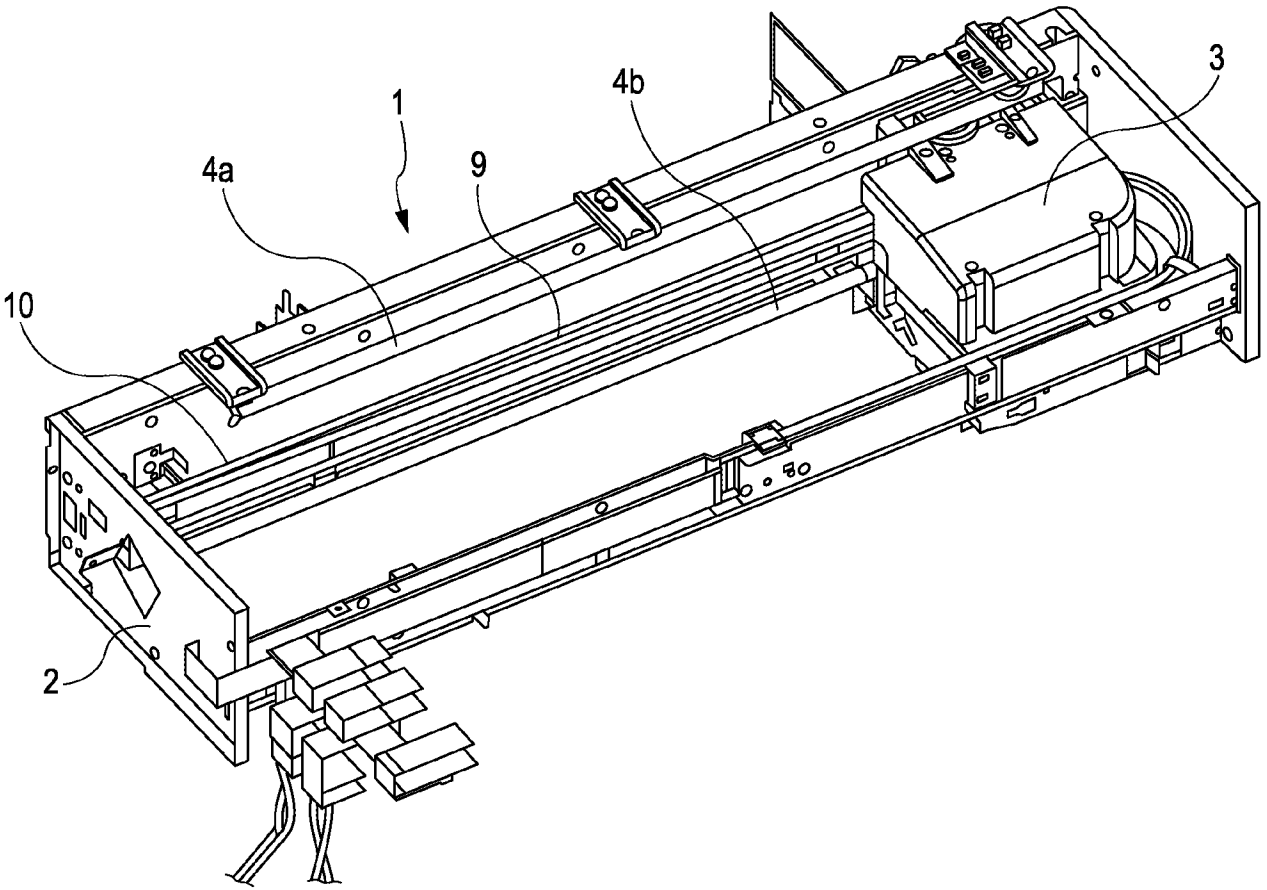
FIG. 1 is a perspective view illustrating a part of an internal configuration of a printer.
Figure 2:
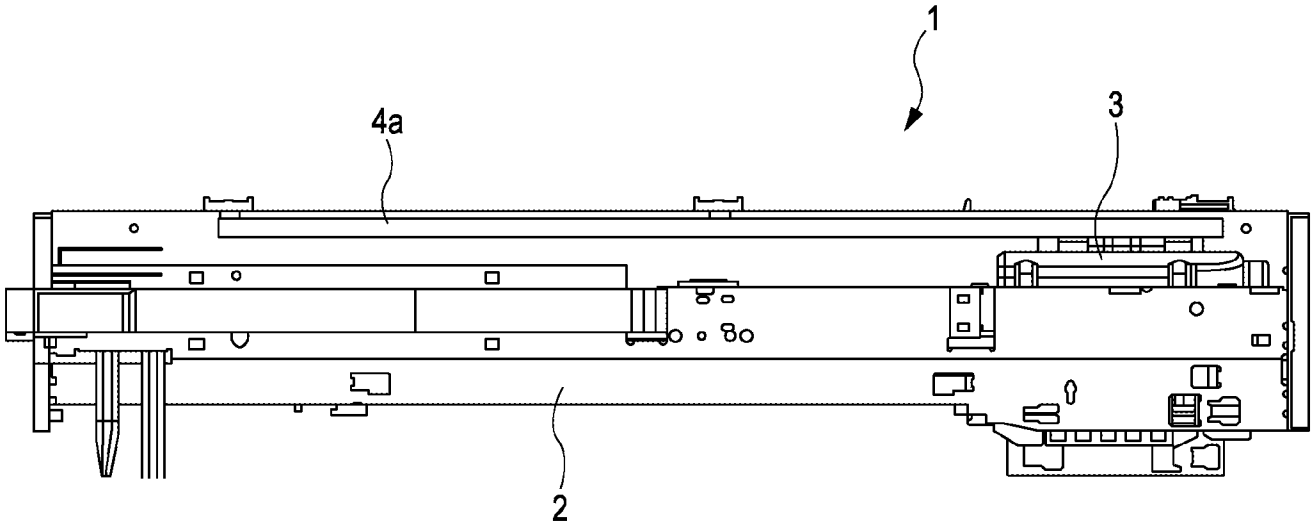
FIG. 2 is a front view illustrating the printer.
Figure 3:
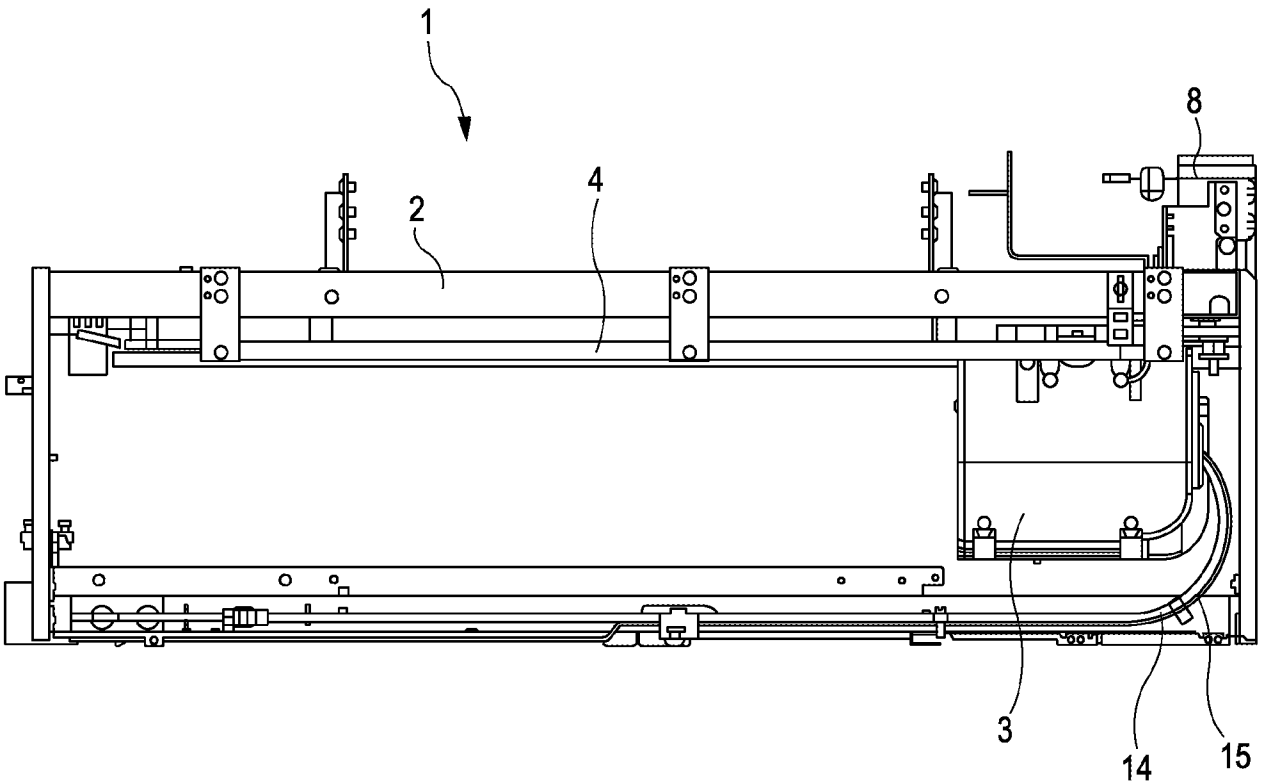
FIG. 3 is a plan view illustrating the printer.
Figure 4:
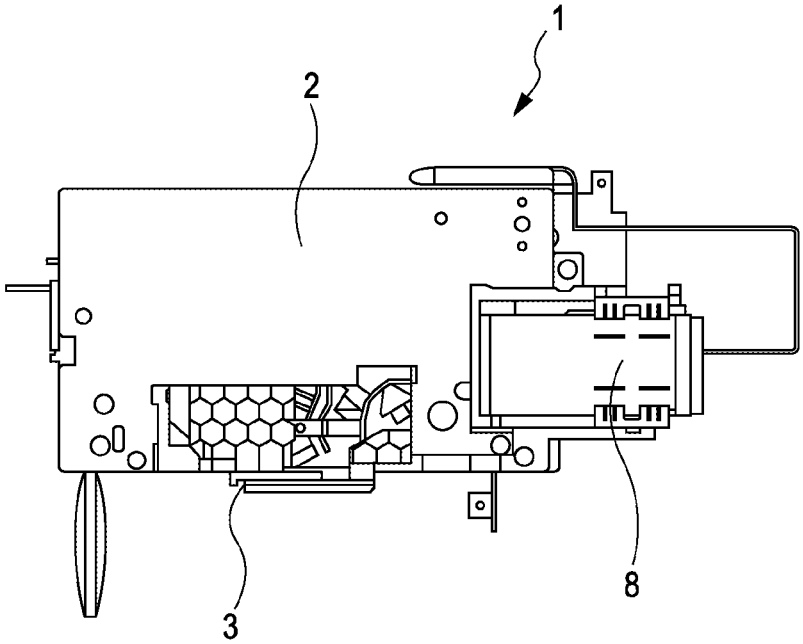
FIG. 4 is a right side view illustrating the printer.

FIG. 1 is a perspective view illustrating a part of an internal configuration of a printer 1, FIG. 2 is a front view illustrating the printer 1, FIG. 3 is a plan view illustrating the printer 1, and FIG. 4 is a right side view illustrating the printer 1. The exemplified printer 1 is configured to eject an ink which is a type of liquid toward a recording medium (an impact target) such as a recording sheet, a cloth, and a film. The printer 1 has a configuration in which a carriage assembly 3 (a type of unit holding member) is mounted into a frame 2 so as to move in a reciprocating manner in the primary scanning direction which is a direction intersecting the transportation direction of the recording medium. A pair of upper and lower guide rods 4*a* and 4*b* is attached to the inner wall of the frame 2 near the rear surface of the printer 1 along the frame 2 so as to be elongated in the length direction and for each to be parallel to each other with a gap therebetween. The carriage assembly 3 is slidably supported by the guide rods 4*a* and 4*b* in a manner such that the guide rods 4*a* and 4*b* are fitted to a bearing portion 7 (refer to FIG. 7) provided at the rear surface of the carriage assembly 3.

One end (the right end portion in FIG. 3) of the rear surface of the frame 2 in the primary scanning direction is provided with a carriage motor 8 which is a driving source for moving the carriage assembly 3. The driving shaft of the carriage motor 8 protrudes from the rear surface side of the frame 2 toward the inner surface side thereof, and the front end portion is connected to a driving pulley (not shown). The driving pulley is rotated by the driving of the carriage motor 8. Further, an idling pulley (not shown) is provided at a position (the left end portion in FIG. 3) opposite to the driving pulley in the primary scanning direction. A timing belt 9 is suspended on these pulleys. The timing belt 9 is connected to the carriage assembly 3. Further, when the carriage motor 8 is driven, the timing belt 9 is rotated with the rotation of the driving pulley, and the carriage assembly 3 moves in the primary scanning direction along the guide rods 4*a* and 4*b*.

A linear scale 10 (an encoder film) is provided at the inner wall of the rear surface of the frame 2 so as to be parallel to the guide rods 4*a* and 4*b* in the primary scanning direction. The linear scale 10 is a band-like member, and in the embodiment, the linear scale is manufactured by forming a plurality of lengthwise slits (slits which are elongated in the width direction of the band) in a thin base made of stainless steel at the same interval in the length direction. Further, a linear encoder 11 is provided at the rear surface side of the carriage assembly 3 so as to optically read out the presence of the slits of the linear scale 10 (refer to FIG. 15). The linear encoder 11 includes, for example, a pair of light emitting and receiving elements which are positioned opposite each other, and outputs an encoder pulse in accordance with a difference between a light receiving state at the slit of the linear scale 10 and a light receiving state at other portions thereof. That is, the linear encoder 11 is a type of position information output unit, and outputs an encoder pulse based on the scanning position of the carriage assembly 3 as position information in the primary scanning direction. Accordingly, a control unit (not shown) of the printer may control a recording operation performed on the recording medium using a head unit 17 while recognizing the scanning position of the carriage assembly 3 on the basis of the encoder pulse output from the linear encoder 11. Further, the printer 1 is configured to perform a so-called bi-directional recording operation in which characters, images, and the like are bi-directionally recorded on the recording sheet during a forward movement moving the carriage assembly 3 from a home position at one end of the primary scanning direction toward the opposite end (a full position) and a backward movement returning the carriage assembly 3 from the full position toward the home position.

As shown in FIG. 3, the carriage assembly 3 is connected with an ink supply tube 14 supplying each color of an ink to each recording head 18 of the head unit 17 and a signal cable 15 supplying a signal such as a driving signal. In addition, although it is not shown in the drawings, the printer 1 is provided with a cartridge attachment unit to which an ink cartridge (a liquid supply source) storing an ink is detachably attached, a transportation unit which transports the recording sheet, a capping unit which caps a nozzle formation surface 53 (refer to FIG. 17) of the recording head 18 waiting in a standby state, and the like.

Figure 5:
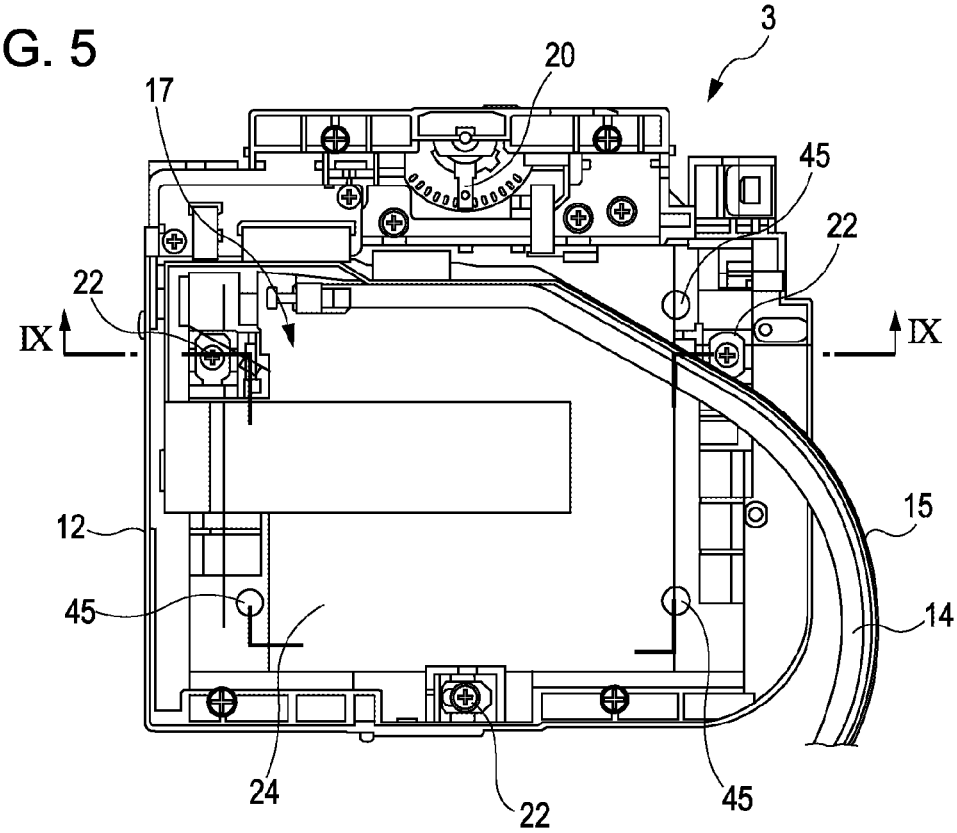
FIG. 5 is a plan view illustrating a carriage assembly.
Figure 6:
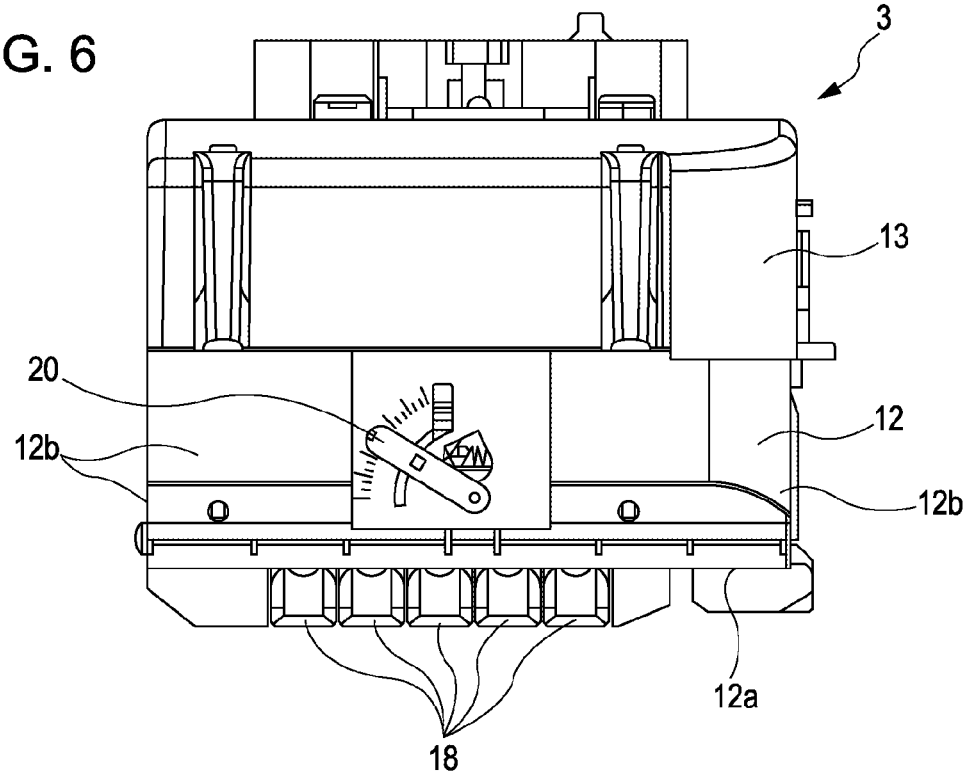
FIG. 6 is a front view illustrating the carriage assembly.
Figure 7:
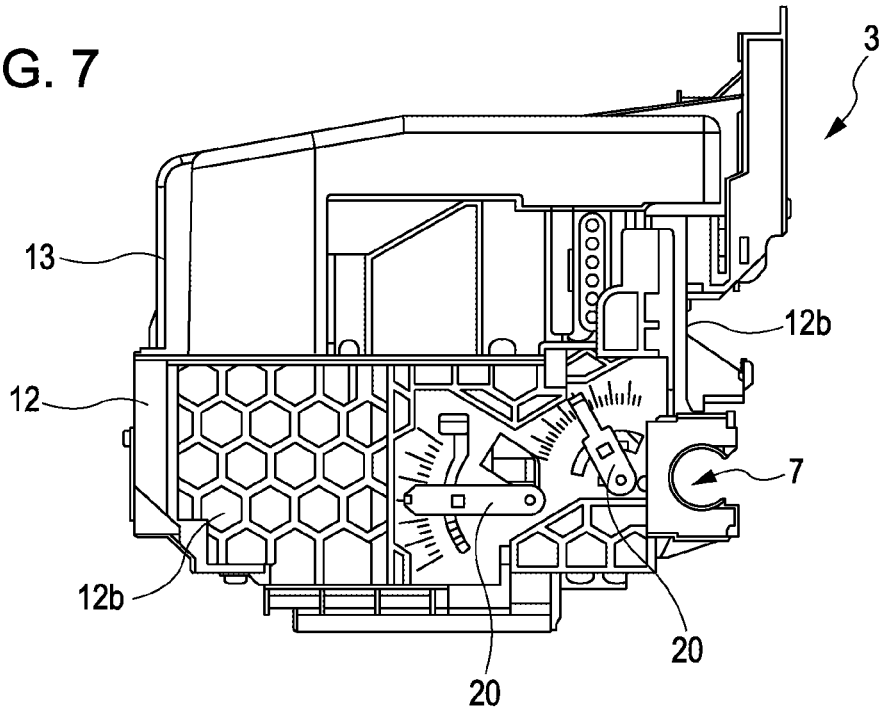
FIG. 7 is a right side view illustrating the carriage assembly.
Figure 8:
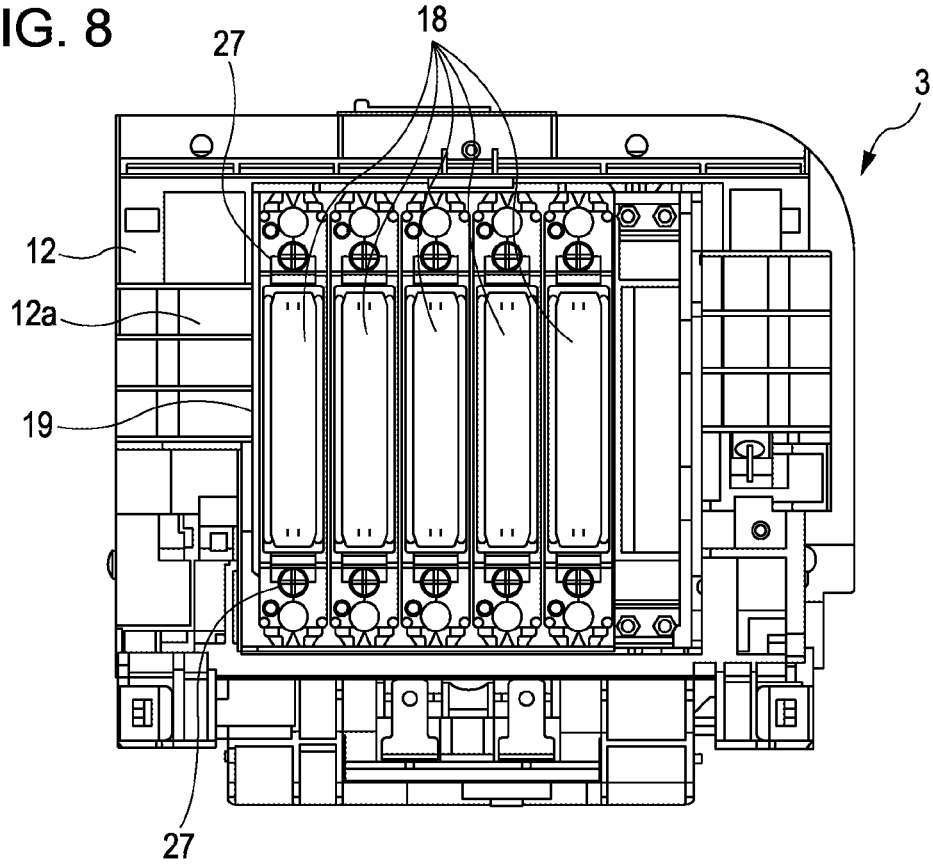
FIG. 8 is a bottom view illustrating the carriage assembly.
Figure 9:
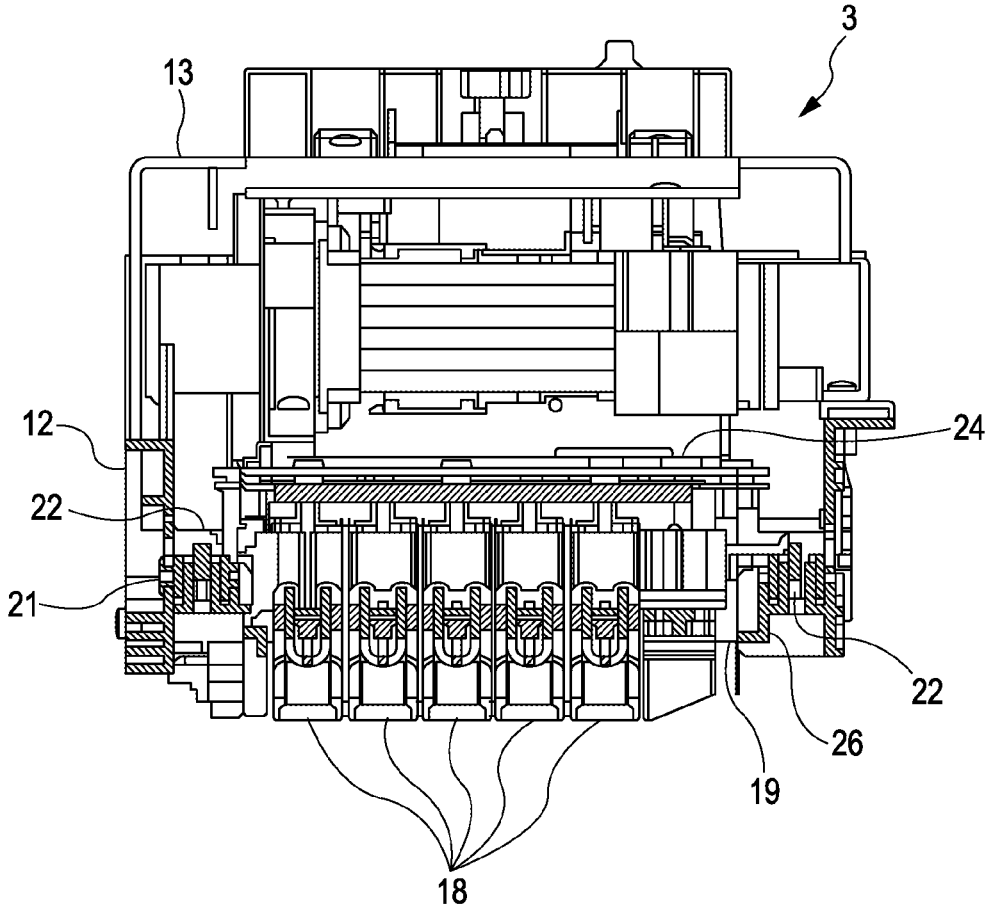
FIG. 9 is a cross-sectional view taken along the line IX-IX of FIG. 5.

FIG. 5 is a plan view illustrating the carriage assembly 3, FIG. 6 is a front view illustrating the carriage assembly 3, FIG. 7 is a right side view illustrating the carriage assembly 3, and FIG. 8 is a bottom view illustrating the carriage assembly 3. Further, FIG. 9 is a cross-sectional view taken along the line IX-IX of FIG. 5. Furthermore, FIG. 5 illustrates a state where a carriage cover 13 is detached. The carriage assembly 3 includes a carriage body 12 which has a head unit 17 (a type of liquid ejecting head unit of the invention) to be described later mounted therein and the carriage cover 13 which covers the upper opening of the carriage body 12, and is a hollow box-like member which may be segmented into upper and lower portions. The carriage body 12 includes a substantially rectangular bottom plate portion 12*a* and a side wall portion 12*b* uprightly formed from each of the outer peripheral edges of the four sides of the bottom plate portion 12*a*, and accommodates the head unit 17 in a space surrounded by the bottom plate portion 12*a* and the side wall portions 12*b*. The bottom plate portion 12*a* is provided with a bottom opening 19 in order to expose the nozzle formation surface 53 of each recording head 18 of the accommodated head unit 17. Further, in the state where the head unit 17 is accommodated in the carriage body 12, the nozzle formation surface 53 of each recording head 18 protrudes from the bottom opening 19 of the bottom plate portion 12*a* toward a position below the lower portion of the carriage body 12 (toward the recording medium during the recording operation).

Figure 15:
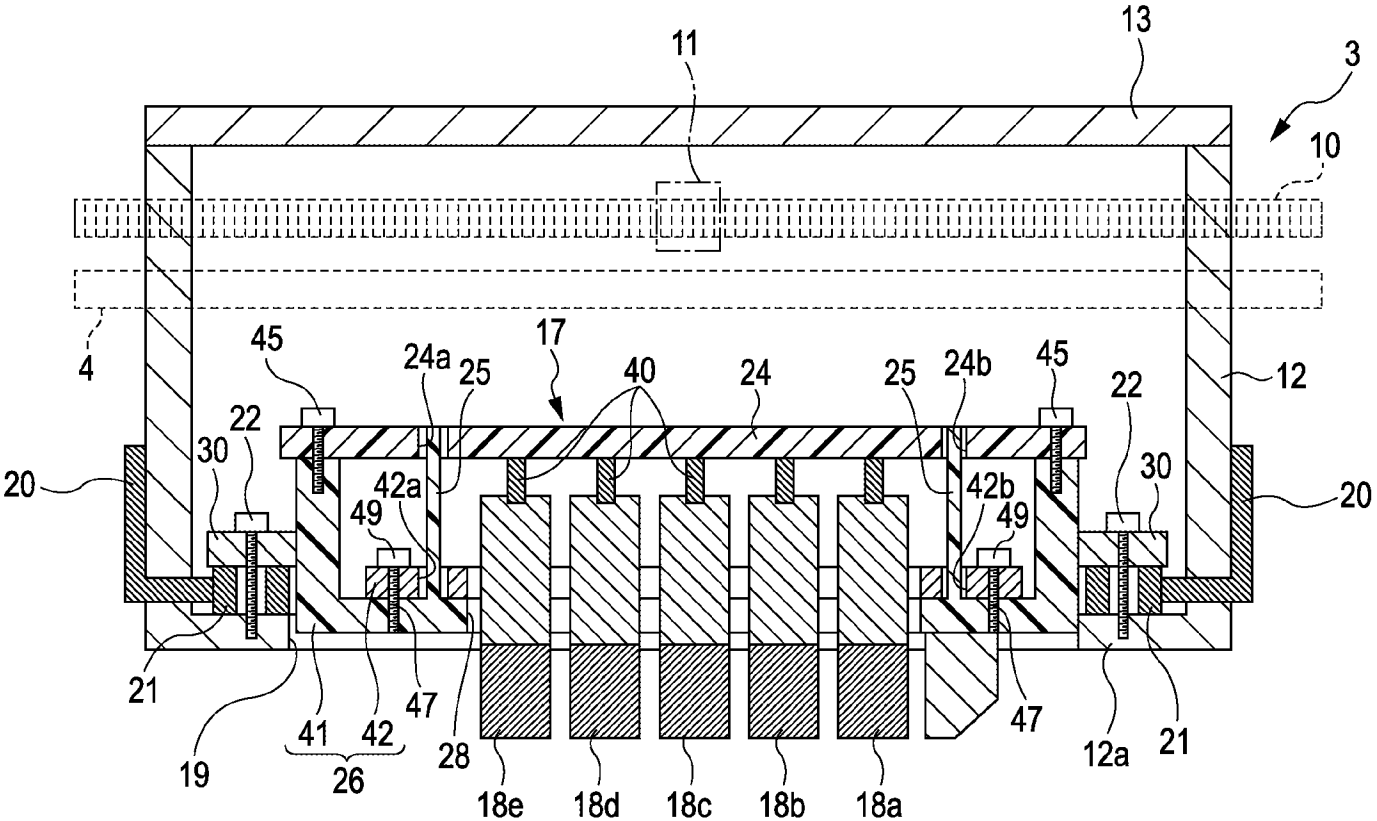
FIG. 15 is a cross-sectional view more simply illustrating a configuration of the carriage assembly.

A plurality of eccentric cams 21 (a type of a position adjusting mechanism of the invention; refer to FIG. 15) is provided between the carriage body 12 and the head unit 17 so as to adjust the posture of the head unit 17 accommodated in the carriage body 12. Further, the carriage body 12 is provided with a plurality of adjustment levers 20 which rotates the eccentric cams 21. The eccentric cams 21 are rotated by the operation of the adjustment levers 20, so that the diameter of the cam from the rotation center to the outer peripheral surface thereof increases or decreases. Accordingly, a posture such as a position or an inclination of the head unit 17 accommodated in the carriage body 12 with respect to the carriage body 12 may be adjusted in accordance with an increase or a decrease in the diameter of the cam. That is, the distance (the platen gap) from the nozzle formation surface 53 of each recording head 18 (refer to FIG. 17) to the platen near the body of the printer 1 or the parallelism may be minutely adjusted by the eccentric cams 21. Furthermore, the position adjusting mechanism is not limited to the exemplified eccentric cam 21, but may be for example, a set screw or the like.

Figure 10A:
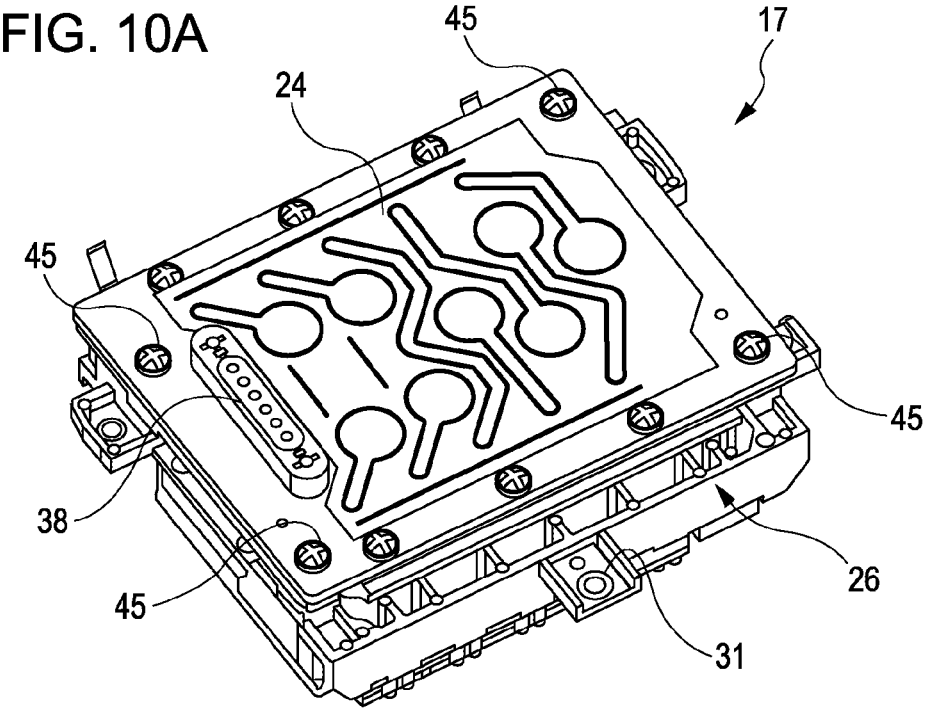
FIGS. 10A and 10B are perspective views illustrating a head unit.
Figure 10B:
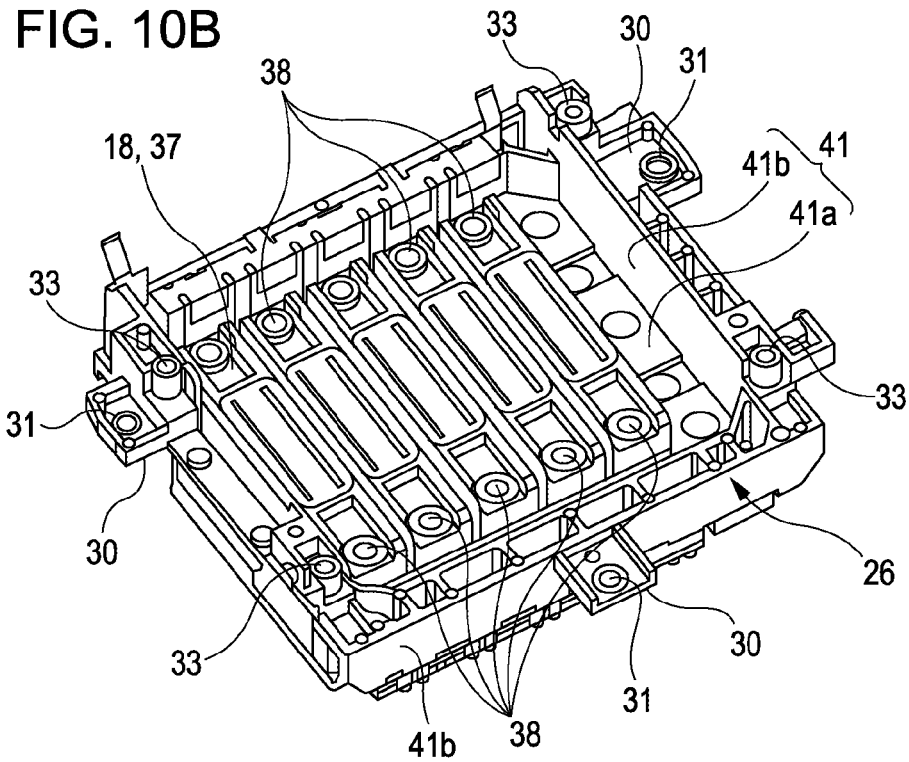
Figure 11:
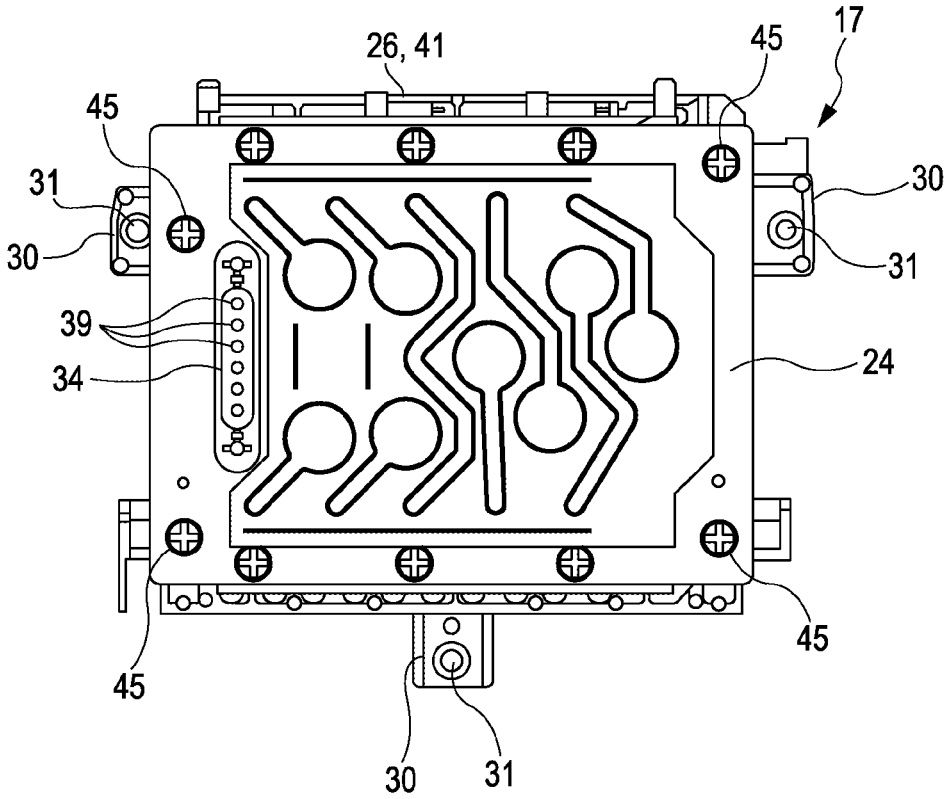
FIG. 11 is a plan view illustrating the head unit.
Figure 12:
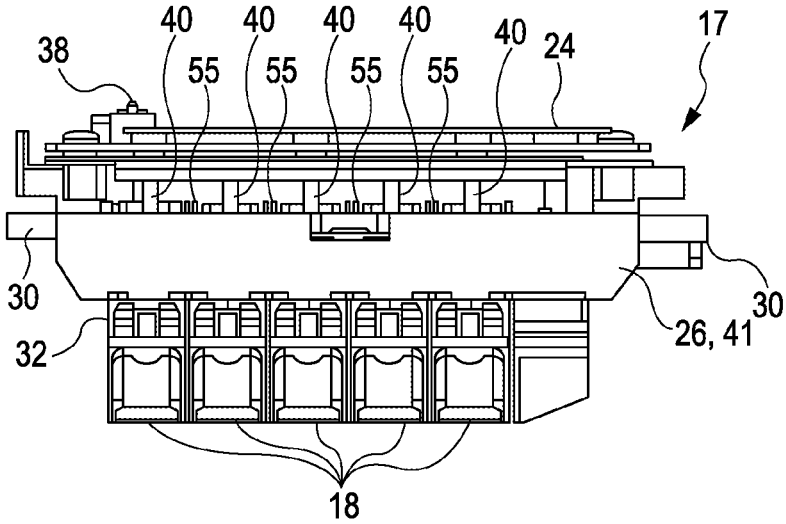
FIG. 12 is a front view illustrating the head unit.
Figure 13:
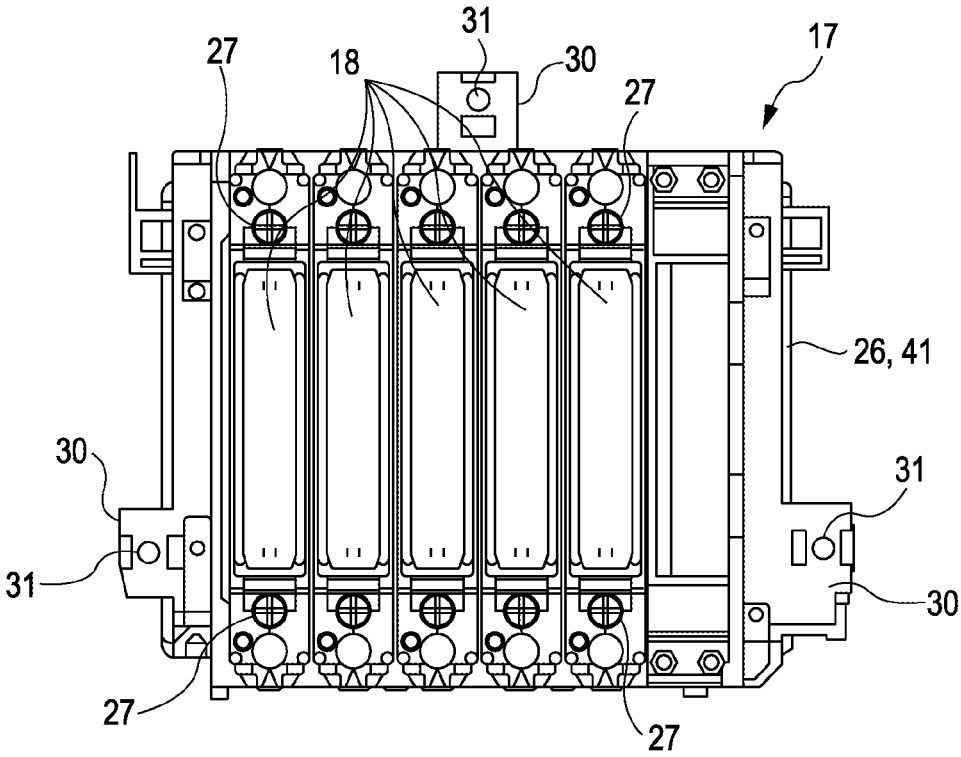
FIG. 13 is a bottom view illustrating the head unit.
Figure 14:
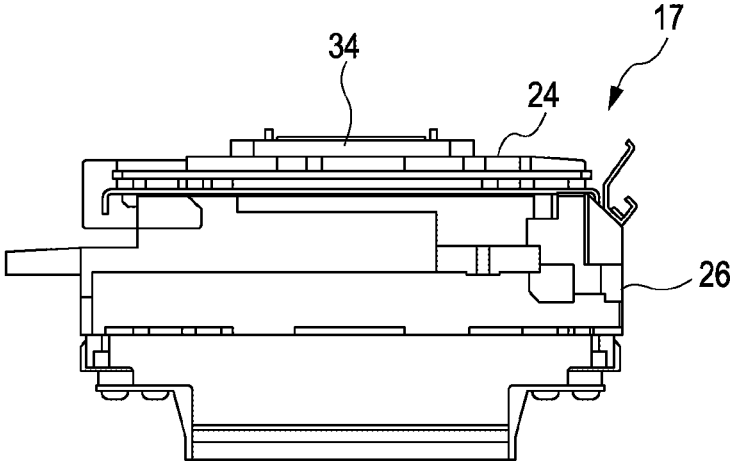
FIG. 14 is a right side view illustrating the head unit.

FIGS. 10A and 10B are perspective views illustrating the head unit 17, where FIG. 10A illustrates a state where a passage member 24 is attached and FIG. 10B illustrates a state where the passage member 24 is detached. Further, FIG. 11 is a plan view illustrating the head unit 17, FIG. 12 is a front view illustrating the head unit 17, FIG. 13 is a bottom view illustrating the head unit 17, and FIG. 14 is a right side view illustrating the head unit 17. Further, FIG. 15 is a cross-sectional view more simply illustrating the configuration of the carriage assembly 3 for convenience of description.

The head unit 17 is formed as a unit including the plurality of recording heads 18 and the like, and includes a sub-carriage 26 (a type of head fixing member of the invention) to which the recording heads 18 are attached and the passage member 24. The sub-carriage 26 includes a head holding unit 42 (refer to FIG. 15) to which the recording heads 18 are fixed and a body 41 to which the head holding unit 42 is fixed, and is configured by the combination of the head holding unit 42 and the body 41.

As shown in FIG. 10B, the body 41 is formed as a hollow box-like body of which the upper surface is opened and includes a plate-like base portion 41*a* and upright wall portions 41*b* uprightly formed respectively from the outer peripheral edges of the four sides of the base portion 41*a*. The space surrounded by the base portion 41*a* and the upright wall portions 41*b* serves as an accommodation portion that accommodates the head holding unit 42 having the recording head 18 fixed thereto. The body 41 of the embodiment is made of a material of which the rigidity is lower than that of the head holding unit 42, for example, a synthetic resin and more particularly a modified polyphenylene ether resin. The approximate center portion of the base portion 41*a* of the body 41 is provided with a head insertion opening 28 (that is, one head insertion opening common to the respective recording heads 18) through which the plurality of recording heads 18 is inserted (refer to FIG. 15). For this reason, the base portion 41*a* is formed as a frame. The four corners of the base portion 41*a* are respectively provided with four fixing holes (female screw portions) 47 corresponding to four holding unit insertion holes 48 (refer to FIG. 16) of a head holding unit 42 to be described later. Further, two positioning pins 25 are provided at both sides of the head insertion opening 28 in the head arrangement direction so as to be upright upward (the side of the attached passage member 24) (refer to FIG. 15). The protrusion length of the positioning pin 25 from the base portion 41*a* is set to be slightly longer than the height of the upright wall portion 41*b*. Further, the positioning pins 25 are configured to define the relative position between the body 41, the head holding unit 42, and the passage member 24 by being inserted into holding portion positioning holes 42*a* and 42*b* to be described later and passage positioning holes 24*a* and 24*b* of the passage member 24. Furthermore, a configuration may be adopted in which the positioning pin is provided in the head holding unit 42 and a positioning hole corresponding thereto is provided in the body 41.

As shown in FIG. 11 and the like, a flange portion 30 is provided at each of three upright wall portions of upright wall portions 41*b* provided at four sides of the body 41 so as to protrude laterally. An insertion hole 31 is provided at the flange portion 30 so as to correspond to each of three attachment screw holes (not shown) provided at the attachment position of the bottom plate portion 12*a* of the carriage body 12 with respect to the head unit 17. Further, the head unit 17 is accommodated and fixed in the carriage body 12 in a manner such that the head unit fixing screw 22 is screw-fixed to the attachment screw hole via the insertion hole 31 in the state where the corresponding insertion hole 31 is positioned to each attachment screw hole of the bottom plate portion 12*a* of the carriage body 12. Furthermore, as described above, a posture such as a position or an inclination of the head unit 17 with respect to the carriage body 12 is adjusted by the operation of the adjustment levers 20 in the procedure before fixing the head unit 17 to the carriage body 12. Further, four fixing screw holes 33 are provided at the upper end surfaces of the upright wall portions 41*b* at four sides of the body 41 so as to fix the passage member 24 thereto.

Figure 16:
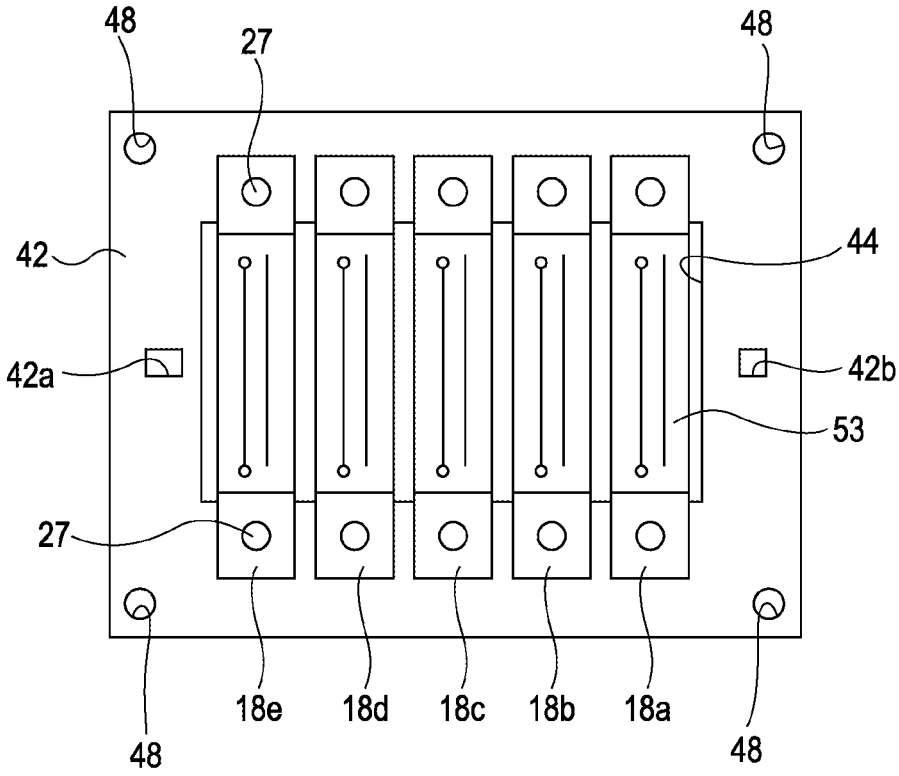
FIG. 16 is a plan view illustrating a head holding unit.

FIG. 16 is a plan view illustrating the head holding unit 42 (a bottom view when seen from the nozzle formation surface 53 of the recording head 18). The head holding unit 42 is a frame-like member, and for example, is made of metal such as stainless steel or aluminum, so that the rigidity thereof is higher than that of the body 41 made of a synthetic resin. In the embodiment, the dimensions of the head holding unit 42 in the lengthwise direction (the vertical direction in FIG. 16 corresponding to the nozzle row direction of the attached recording head 18) and the widthwise direction (the horizontal direction in FIG. 16 in the direction perpendicular to the lengthwise direction) are set to be smaller than those of the base portion 41*a* of the body 41 in the corresponding directions, and are set to be larger than those of the head insertion opening 28 in the corresponding directions. Further, the approximate center of the head holding unit 42 is provided with a head opening 44 through which the plurality of recording heads 18 is inserted. The opening dimensions (the lengthwise and widthwise dimensions) of the head opening 44 are defined by the opening dimensions of the head insertion opening 28. The rear surface (the surface facing the recording medium during the recording operation) of the head holding unit 42 is provided with a head threading hole 29 (a female screw portion) corresponding to the attachment position of each recording head 18 (refer to FIG. 18). In the embodiment, two head threading holes 29 are provided at each side of the attachment position of one recording head 18 in the direction corresponding to the nozzle row direction with the head opening 44 interposed therebetween so as to correspond to a sub-carriage insertion hole 32" of a spacer 32 to be described later, and the head threading holes are provided at four positions in total. In the embodiment, five recording heads 18, that is, the first recording head 18*a*, the second recording head 18*b*, the third recording head 18*c*, the fourth recording head 18*d*, and the fifth recording head 18*e* are uniformly fixed to the head holding unit 42 in a direction perpendicular to the nozzle row as shown in FIG. 16 in a manner such that a sub-tank 37 to be described later is inserted from the lower side of the head opening 44 and each spacer 32 (refer to FIG. 18) is interposed between the flange portion 52*a* of the recording head 18 and the head holding unit.

Holding unit insertion holes 48 are respectively provided at four corners of the head holding unit 42 so as to respectively correspond to four fixing holes 47 of the base portion 41*a* of the body 41. The holding portion positioning holes 42*a* and 42*b* are respectively provided at both sides of the head opening 44 in the head arrangement direction in a manner of perforating the plate in the thickness direction so as to have a rectangular shape in the plan view. With regard to one holding portion positioning hole 42*a* among the holding portion positioning holes 42*a* and 42*b*, the widthwise dimension thereof in the arrangement direction (the head arrangement direction) of the positioning holes 42*a* and 42*b* is set to be sufficiently larger than the diameter of the positioning pin 25, and the lengthwise dimension in the direction perpendicular to the arrangement direction of the positioning holes 42*a* and 42*b* is set to be equal to or slightly larger than the diameter of the positioning pin 25. That is, one holding portion positioning hole 42*a* is formed as a hole which is elongated in the widthwise direction, and when the positioning pin 25 is inserted through the one holding portion positioning hole 42*a*, the movement in the lengthwise direction is regulated and the movement in the widthwise direction is permitted. In contrast, each of the lengthwise and widthwise dimensions of the other holding portion positioning hole 42*b* is set to be equal to or slightly larger than that of the positioning pin 25. That is, when the positioning pin 25 is inserted through the other holding portion positioning hole 42*b*, the movement of the positioning pin 25 is regulated so that rattling is prevented. Furthermore, the planar shape (the opening shape) of the positioning hole is not limited to the exemplified rectangular shape, and may be, for example, a circular shape or an oval shape.

Further, when the head holding unit 42 is disposed on the base portion 41*a* by respectively inserting (fitting) the positioning pins 25 near the body 41 through (to) the holding portion positioning holes 42*a* and 42*b* near the head holding unit 42, the position of the head holding unit 42 with respect to the base portion 41*a* is defined. Furthermore, as described above, since one of the holding portion positioning holes 42*a* and 42*b* is formed as an elongated hole, dimension errors of the positioning pin 25 and the holding portion positioning holes 42*a* and 42*b* are permitted. In the state where the head holding unit 42 is disposed at the base portion 41*a* in this manner, the position of each holding unit insertion hole 48 of the head holding unit 42 and the position of each corresponding fixing hole 47 of the base portion 41*a* are substantially aligned with each other. In this state, when a holding unit threading screw 49 is threaded into (screw-fixed to) the fixing hole 47 via the holding unit insertion hole 48, the head holding unit 42 is fixed to the body 41. The head holding unit 42 may be detached while the body 41 is fixed to the carriage body 12 in a manner such that the carriage cover 13 is detached from the carriage body 12 while the head unit 17 is assembled to the carriage assembly 3, the passage member 42 is detached from the body 41, and the fastening state of the holding unit threading screw 49 is released. Accordingly, replacement or maintenance of each recording head 18 fixed to the head holding unit 42 may be facilitated. Further, all recording heads 18 may be replaced for each head holding unit 42. Further, a posture such as a position or an inclination of the head unit 17 with respect to the carriage body 12 may be easily adjusted again through the operation of the adjustment levers 20 after replacement or maintenance.

Here, with regard to the rigidity (Young's modulus) of each of the body 41 and the head holding unit 42, when the rigidity of the body 41 is, for example, 9.27 GPa, the rigidity of the head holding unit 42 is, for example, 61.8 GPa when it is made of aluminum and is, for example, 197 GPa when it is made of stainless steel. It is desirable that the rigidity of the head holding unit 42 is at least five times the rigidity of the body 41. Further, with regard to the specific weight, when the specific weight of the body 41 is, for example, $1.43\times10^{-6}$ kg/mm$^3$, the specific weight of the head holding unit 42 is, for example, $2.70\times10^{-6}$ kg/mm$^3$ when it is made of aluminum and is, for example, $7.93\times10^{-6}$ kg/mm$^3$ when it is made of stainless steel. That is, the rigidity of the head holding unit 42 to which the plurality of recording heads 18 is fixed increases in order to ensure the positioning precision of each recording head 18, whereas the body 41 is made of a material having rigidity and specific weight lower than those of the head holding unit 42, whereby a decrease in weight is realized. Further, the body 41 made to have low rigidity in this manner exhibits a function of preventing the head holding unit 42 from being deformed by actively absorbing the rotational moment generated during the screw-fixing operation so that it is deformed instead. Furthermore, the specific numerical values of the rigidity and the specific weight are not limited to the examples in the embodiment.

Further, in the embodiment, since the head holding unit 42 and the linear scale 10 are made of the same material, both linear expansion coefficients are uniformly set. For example, when the head holding unit 42 and the linear scale 10 are respectively made of stainless steel, both linear expansion coefficients are uniformly set as $17.3\times10^{-6}$/° C. Further, for example, when the head holding unit 42 and the linear scale 10 are respectively made of aluminum, both linear expansion coefficients are uniformly set as $23\times10^{-6}$/° C. Since the linear expansion coefficients of the head holding unit 42 and the linear scale 10 are uniformly set in this manner, it is possible to suppress a deviation in impact position of an ink with respect to a recording medium when the environmental temperature increases. That is, when the linear expansion coefficients of the head holding unit 42 and the linear scale 10 differ from each other, an error occurs between the actual position of the recording head 18 and the position of the recording head 18 in the primary scanning direction detected by a control based on the encoder pulse output from the linear encoder 11 when a temperature increases. Further, the impact position of the ink with respect to the recording medium deviates due to the error. Particularly, for example, when a recording operation is performed in a manner such that the nozzle 51 of the first recording head 18*a* ejects an ink to impact a predetermined position of the recording medium and the nozzle 51 of the fifth recording head 18*e* farthest from the first recording head 18*a* ejects an ink to overlap with the predetermined position, the deviation in the impact position becomes noticeable. That is, in the head unit in which the number of the recording heads 18 is large and the length thereof is long, there is a tendency that an influence of a deviation in the impact position based on a difference in the linear expansion coefficient increases. In contrast, since the linear expansion coefficients of the head holding unit 42 and the linear scale 10 are uniformly set, and as the error between the actual position and the position in the primary scanning direction of the recording head 18 detected by a control is reduced even when the environmental temperature increases, the deviation in the impact position may be suppressed. Furthermore, the specific numerical value of the linear expansion coefficient is not limited to the examples in the embodiment.

The passage member 24 is a box-like member which is thin in the vertical direction, and is made of, for example, a synthetic resin. In the interior of the passage member 24, an ink distribution passage (not shown) for each color is separately provided to correspond to a passage connection portion 38 of the sub-tank 37 (to be described later) of each recording head 18. The upper surface (the surface opposite to the surface which is fixed to the sub-carriage 26) of the passage member 24 is provided with a tube connection portion 34. As shown in FIG. 11, the interior of the tube connection portion 34 is provided with a plurality of introduction ports 39 corresponding to the respective colors of the inks. Each introduction port 39 communicates with the ink distribution passage for the corresponding color. Further, when the ink supply tube 14 is connected to the tube connection portion 34, the ink supply paths for the respective colors inside the ink supply tube 14 respectively communicate with the corresponding introduction ports 39 in a liquid-tight state. Accordingly, the inks of the respective colors sent from the ink cartridge via the ink supply tube 14 are respectively supplied to the ink distribution passages inside the passage member 24 via the introduction port 39. A passage insertion hole (not shown) is formed at each of the four corners of the passage member 24 so as to correspond to the fixing screw hole 33 of the body 41 in a manner of perforating the plate in the thickness direction. When the passage member 24 is fixed to the sub-carriage 26, a passage threading screw 45 is threaded into the fixing screw hole 33 via the passage insertion hole.

As shown in FIGS. 12 and 15, a connection passage 40 is provided at a position corresponding to the passage connection portion 38 of the sub-tank 37 of each recording head 18 in the lower surface of the passage member 24 so as to extend downward. The connection passage 40 is a hollow cylindrical member which has therein a deriving path (not shown) communicating with the ink distribution path for the corresponding color. The connection passage 40 is inserted into the passage connection portion 38 of the sub-tank 37 of each recording head 18 to be liquid-tightly connected thereto. Further, the ink passing through the ink distribution passage inside the passage member 24 is supplied to the sub-tank 37 of each recording head 18 via the connection passage 40 and the passage connection portion 38. That is, the ink supply tube 17 and the sub-tank 37 are connected to each other via the passage member 24.

Further, the passage positioning holes 24*a* and 24*b* are respectively provided at the positions respectively corresponding to the positioning pins 25 protruding from the body 41 of the sub-carriage 26 in the lower surface of the passage member 24. The passage positioning holes 24*a* and 24*b* are also rectangular holes in the plan view as in the holding portion positioning holes 42*a* and 42*b*. The opening dimensions of the passage positioning holes 24*a* and 24*b* may be uniformly set to the opening dimensions of the corresponding holding portion positioning holes 42*a* and 42*b*. For this reason, one passage positioning hole 24*a* is formed as an elongated hole in the widthwise direction as the arrangement direction of the positioning holes 24*a* and 24*b*. Further, when the passage member 24 is attached to the body 41 of the sub-carriage 26, the positioning pins 25 protruding from the body 41 are respectively inserted into the corresponding passage positioning holes 24*a* and 24*b*, so that the disposition position of the passage member 24 with respect to the body 41 is defined.

Figure 17:
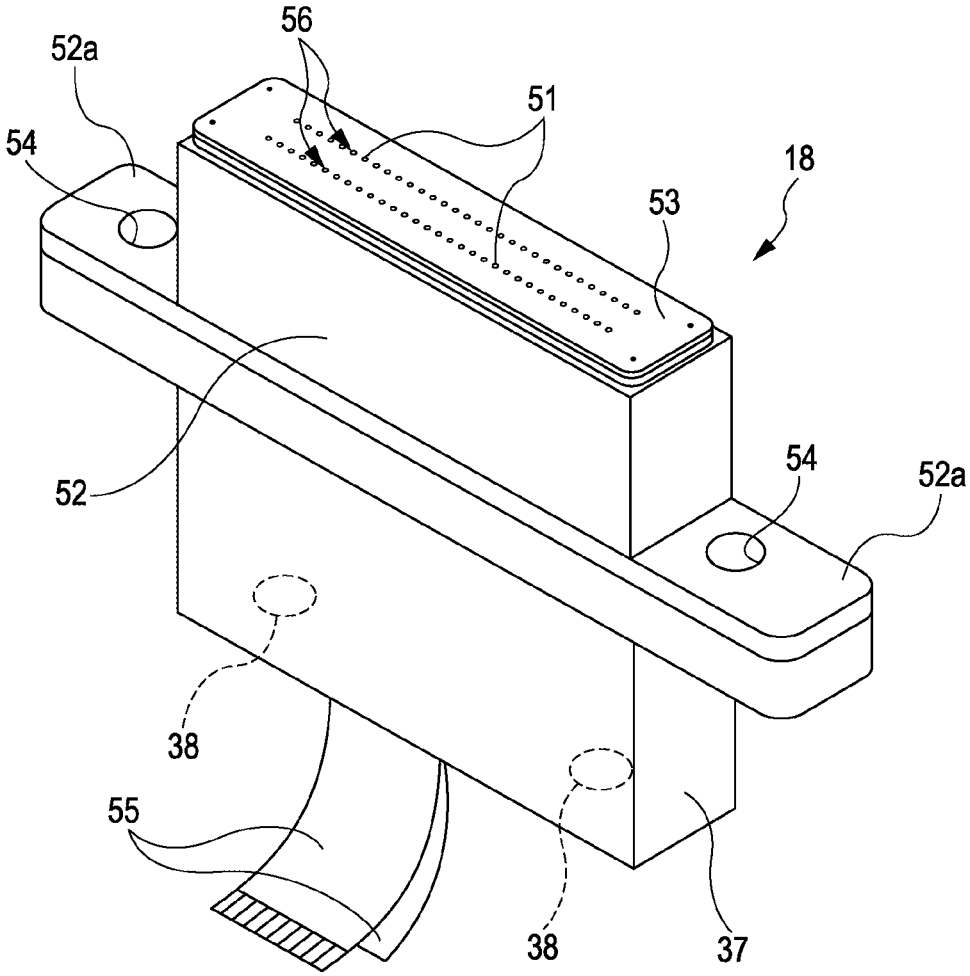
FIG. 17 is a perspective view illustrating a configuration of a recording head.

FIG. 17 is a perspective view illustrating a configuration of the recording head 18 (a type of liquid ejecting head). Furthermore, since the basic structure and the like are common in the respective recording heads 18, one of the five recording heads 18 attached to the sub-carriage 26 is representatively shown.

The recording head 18 includes a head casing 52 which has a passage unit forming an ink passage having a pressure chamber communicating with the nozzle 51 or a pressure generating unit such as a heating element or a piezoelectric oscillator generating a pressure fluctuation in the ink inside the pressure chamber, where those units are not shown in the drawings. The recording head 18 is configured to perform a recording operation in which a driving signal is applied from the control unit of the printer 1 to the pressure generating unit to drive the pressure generating unit so that an ink is ejected from the nozzle 51 to impact a recording medium such as a recording sheet. In the nozzle formation surface 53 of each recording head 18, a nozzle row 56 (a type of nozzle group) is configured by arranging the plurality of nozzles 51 ejecting an ink, and two nozzle rows 56 are arranged in the direction perpendicular to the nozzle row. One nozzle row 56 includes 360 nozzle openings which are provided at the pitch of, for example, 360 dpi. The ink passage or the pressure generating unit corresponding to each nozzle row 56 is individually provided, and different inks may be respectively allocated to two nozzle rows 56 of the same recording head 18.

The head casing 52 is a hollow box-like member, and the passage unit is fixed to the front end thereof while the nozzle formation surface 53 is exposed. Further, the pressure generating unit or the like is accommodated in an accommodation space formed inside the head casing 52, and the sub-tank 37 is attached to the base end surface (the upper surface) opposite to the front end surface so as to supply an ink to the passage unit. Further, the flange portions 52*a* are respectively formed at both sides of the upper surface of the head casing 52 in the nozzle row direction so as to protrude laterally. Each flange portion 52*a* is provided with a spacer attachment hole 54 corresponding to a head insertion hole 32' (refer to FIG. 18) of the spacer 32. When the spacer 32 is attached to the flange portion 52*a*, a spacer fixing screw 27 is inserted through the spacer attachment hole 54.

The spacer 32 is a member made of a synthetic resin, and two spacers are respectively attached to both sides of the upper surface (the surface near the sub-tank 37) of the flange portion 52*a* with respect to one recording head 18. The center portion of the spacer 32 in the width direction (the direction perpendicular to the nozzle row while being attached to the recording head 18) is provided with the head insertion hole 32' corresponding to the spacer attachment hole 54 of the recording head 18. Further, both end portions of the spacer 32 in the width direction are respectively provided with the sub-carriage insertion holes 32" corresponding to the head threading holes 29 of the head holding unit 42 of the sub-carriage 26. That is, the spacer 32 is provided with one head insertion hole 32' and two sub-carriage insertion holes 32". The spacer 32 is fastened to each of the flange portions 52*a* at both sides of each recording head 18 by a spacer threading screw 43 before the recording head 18 is attached to the head holding unit 42. As described below, the spacer 32 is fixed to the head holding unit 42 by the spacer fixing screw 27 after it is temporarily fixed thereto by adhesive. The recording head 18 once fixed to the head holding unit 42 may be detached from the spacer 32 and the head holding unit 42 by releasing the fastening state of the spacer threading screw 43 between the spacer 32 and the recording head. Accordingly, the recording head 18 may be easily detached for the purpose of replacement or repair of the recording head 18.

The sub-tank 37 is a member that introduces the ink from the passage member 24 to the pressure chamber of the recording head 18. The sub-tank 37 has a self sealing function that opens and closes a valve in accordance with an internal pressure fluctuation and controls the introduction of the ink toward the pressure chamber. The passage connection portions 38 are provided at both end portions of the rear end surface (the upper surface) of the sub-tank 37 in the nozzle row direction so as to be connected to the connection passage 40 of the passage member 24. An annular packing (not shown) is fitted into the passage connection portion 38, and the liquid-tightness against the connection passage 40 is ensured by the packing. Further, two driving substrates (not shown) are provided inside the sub-tank 37 so as to supply a driving signal to the pressure generating unit, and two flexible cables 55 (a type of interconnection member) electrically connected to each driving substrate are respectively exposed from the rear end surface of the sub-tank 37. The flexible cable 55 is connected to the signal cable 15 so as to supply the driving signal or the like transmitted from the control unit of the printer 1 via the signal cable 15 to the pressure generating unit via the driving substrate.

Next, a manufacturing process (an assembly process) of the head unit 17 will be described.

Figure 18:
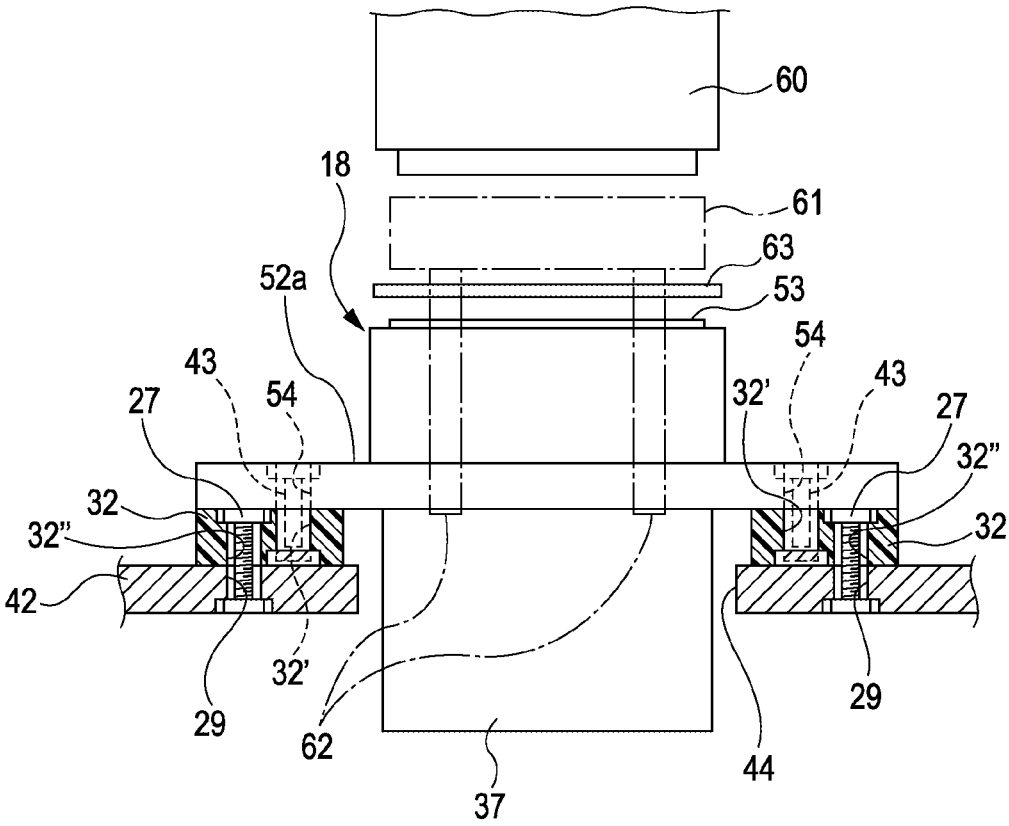
FIG. 18 is a schematic diagram illustrating a configuration for attaching the recording head to a sub-carriage.

FIG. 18 is a schematic diagram illustrating a configuration for attaching the recording head 18 to the head holding unit 42. This apparatus includes an imaging unit 60 such as a CCD camera, a head moving mechanism 61 moving the recording head 18 while holding it, and an alignment substrate 63. Furthermore, in the same drawing, the horizontal direction is set as the nozzle row direction, and the depth direction (the perpendicular direction in the drawing) is set as the direction perpendicular to the nozzle row. The alignment substrate 63 is made of a plate material having permeability such as glass having a linear expansion coefficient which is as low as possible. The alignment substrate 63 is provided with a pair of reference nozzle marks which defines the disposition positions of a plurality of (at least two) specific nozzles 51 (for example, the nozzles 51 at both ends of one nozzle row depicted by the white circle in FIG. 16 and hereinafter, appropriately referred to as reference nozzles) of the recording head 18 (hereinafter, appropriately referred to as a reference head) to be used as a positioning reference as described below and a target nozzle mark which defines the relative position with respect to the reference nozzle of at least two specific nozzles 51 (hereinafter, appropriately referred as target nozzles) of the recording head 18 of the positioning target. With regard to the target nozzle mark, the formation position is set so that the relative position with respect to the reference nozzle mark becomes a designed value (a defined position). In the embodiment, the reference head is the first recording head 18*a*.

The head moving mechanism 61 includes an arm 62 (a type of head holding jig) extending toward the head holding unit 42. The head moving mechanism 61 clamps (holds) the recording head 18 of the attachment target by using the arm 62. In the head attachment process of the embodiment, the relative position of the recording head 18 with respect to the alignment substrate 63 is adjusted on the head holding unit 42 by moving the recording head 18 in the nozzle row direction or the direction perpendicular to the nozzle row direction while the recording head 18 is held by the arm 62 or rotating the recording head 18 in the direction of the nozzle formation surface.

The recording head 18 of the attachment target is set in a posture in which the nozzle formation surface 53 faces the imaging unit 60 by inserting the sub-tank 37 from the head opening 44 and interposing the spacer 32 fastened in advance to the flange portion 52*a* between the upper surface of the flange portion 52*a* and the head holding unit 42. In this state, the recording head 18 is held by the arm 62 of the head moving mechanism 61.

The head attachment process of attaching each recording head 18 to the head holding unit 42 includes a position adjusting process of positioning the recording head 18 to a predetermined position of the head holding unit 42, a temporary fixing process of temporarily fixing the recording head 18 to the head holding unit 42 by adhesive, and a main fixing process of fixing the temporarily fixed recording head 18 to the head holding unit 42 by using the spacer fixing screw 27. In the position adjusting process, as described above, the position adjustment is performed using the alignment substrate 63.

The image captured by the imaging unit 60 is displayed on a monitor (not shown). The monitor displays a transparent alignment substrate 63 to overlap with the nozzle formation surface 53 of the recording head 18 of the attachment target. Further, the position adjustment of the recording head 18 of the attachment target is performed on the head holding unit 42 on the basis of the image displayed on the monitor. Specifically, first, the position of the alignment substrate 63 is adjusted so that the corresponding reference nozzle mark overlaps with each reference nozzle of the reference head displayed on the monitor as an image (in this case, the first recording head 18*a*) (the alignment substrate calibration process). When the position of the alignment substrate 63 is adjusted, next, the position of the recording head 18 is adjusted by using the head moving mechanism 61 so that each target nozzle of the recording head 18 of the attachment target overlaps with the corresponding target nozzle mark on the alignment substrate 63. Accordingly, the relative position of the recording head 18 of the attachment target with respect to the reference head is defined. Further, in the state where the recording head 18 of the attachment target is clamped by the head moving mechanism 61, adhesive flows into a gap between the spacer 32 and the head holding unit 42 by capillary force and the adhesive is solidified, so that the recording head 18 is temporarily fixed (the temporary fixing process). Further, the spacer 32 and the head holding unit 42 are screw-fixed using the spacer fixing screw 27 in the temporary fixed state, so that the recording head 18*d* is fixed to the defined position of the head holding unit 42 (the main fixing process). By sequentially performing the head attachment process of each recording head 18 on the head holding unit 42 in this procedure, each recording head 18 is positioned and fixed with high precision. Furthermore, in the process of attaching each recording head 18 to the head holding unit 42, the rotational moment generated during the screw-fixing operation is exerted on the head holding unit 42, however the deformation of the head holding unit 42 is suppressed since the head holding unit 42 is made of metal so that it has high rigidity. For this reason, each recording head 18 may be fixed to the head holding unit 42 with high positioning precision.

Furthermore, the position adjusting process may be performed without using the exemplified alignment substrate 63. For example, the position adjustment may be performed on the basis of the alignment mark by displaying the alignment mark corresponding to the target nozzle or the reference nozzle of the recording head 18 on the image displayed on the monitor. In this method, the position adjustment is performed in a manner such that a storage unit of a control device stores the position of the reference mark of the alignment substrate with respect to the movement position of each stage where the attachment operation of the recording head 18 is performed and the target nozzle position of the recording head 18 of the attachment target is aligned with the stored position. Further, the amount of positional deviation between the reference nozzle and the reference nozzle mark may be calculated by adjusting the position of the reference nozzle mark with respect to the reference nozzle to be included in the FOV of the imaging unit 60, and the amount of positional deviation of the reference nozzle may be corrected with respect to the positioning instruction value when positioning the recording head 18 of the attachment target.

Further, a configuration may be adopted in which the recording head 18 and the base portion 26*a* are directly positioned with respect to each other without interposing the spacer 32 between the recording head 18 and the base portion 26*a*.

When each recording head 18 is fixed to the head holding unit 42, the head holding unit 42 is attached to the base portion 41*a* of the body 41 (the sub-carriage assembly process). At this time, as described above, the positioning pins 25 near the body 41 are respectively inserted through (fitted to) the holding portion positioning holes 42*a* and 42*b* near the head holding unit 42, the position of the head holding unit 42 with respect to the base portion 41*a* is defined. Further, the holding unit threading screw 49 is screw-fixed to the fixing hole 47 via the holding unit insertion hole 48, so that the head holding unit 42 is fixed to the body 41. At this time, although the rotational moment when fastening the holding unit threading screw 49 is exerted on the head holding unit 42 and the body 41, stress is concentrated on the body 41 more than the head holding unit 42 since the rigidity of the body 41 is lower than that of the head holding unit 42. For this reason, the deformation of the head holding unit 42 may be suppressed when the head holding unit 42 is fixed to the body 41. As a result, the relative position between the recording heads 18 fixed to the head holding unit 42 is barely deviated. In this manner, since the sub-carriage 26 is configured by the combination of the head holding unit 42 having high rigidity and the body 41 having rigidity and specific weight lower than those of the head holding unit 42, it is possible to simultaneously improve the positioning precision of each recording head 18 fixed to the head holding unit 42 and decrease the weight of the sub-carriage 26. That is, since the rigidity of the head holding unit 42 is higher than that of the body 41, it is possible to prevent the frame-like head holding unit 42 from being deformed when each recording head 18 is fixed to (specifically, screw-fixed to) the head holding unit 42 and suppress the relative position between the recording heads 18 fixed to the head holding unit 42 from being deviated from each other. Accordingly, the positioning precision of each nozzle 51 in the head unit 17 improves. Further, since the specific weight of the body 41 is smaller than that of the head holding unit 42, the entire sub-carriage 26 may be decreased in weight. Accordingly, it is possible to decrease the size of the carriage motor 8 as a driving source for moving the head unit 17 mounted on the carriage assembly 3, decrease the size of the entire printer 1, and reduce the cost thereof.

Next, the passage member 24 is fixed to the body 41 of the sub-carriage 26 (the passage attachment process). As described above, the passage member 24 is screw-fixed to the body 41 by the passage threading screw 45. At this time, the positioning pins 25 protruding from the body 41 are respectively inserted into the corresponding passage positioning holes 24*a* and 24*b*, so that the disposition position of the passage member 24 with respect to the body 41 is defined. In the case where the passage member 24 is fixed to the body 41, a rotational moment is generated when fastening the passage threading screw 45, however the rotational moment is absorbed to the body 41, such that the head holding unit 42 is barely affected by the rotational moment. Accordingly, the relative position between the recording heads 18 fixed to the head holding unit 42 is barely deviated. When the passage member 24 is attached to the body 41, the connection passage 40 is inserted into the passage connection portion 38 of the sub-tank 37 of each recording head 18 so as to be liquid-tightly connected thereto. In this manner, the relative position between the head holding unit 42 and the passage member 24 attached to the body 41 may be defined with high precision by adopting a configuration in which the passage member 24 and the head holding unit 42 are positioned with respect to the body 41 by using the common positioning pins 25. Accordingly, it is possible to suppress the relative position therebetween from being deviated and prevent stress from being generated between the passage member 24 and the head holding unit 42 due to positional deviation. As a result, the positioning precision of each recording head 18 of the head holding unit 42 is ensured. Further, since positional deviation between the head holding unit 42 and the passage member 24 is suppressed, the liquid-tightness between the connection passage 40 and the passage connection portion 38 may improve.

The head unit 17 is completed by the above-described process. As described above, the head unit 17 is accommodated in the carriage body 12 while the nozzle formation surface 53 of each recording head 18 is exposed from the bottom opening 19 of the bottom plate portion 12*a* of the carriage body 12, a posture such as a position and an inclination of the head unit 17 with respect to the carriage body 12 is adjusted, and then the head unit is screw-fixed by the head unit fixing screw 22. Although a rotational moment is generated even when fastening the head unit fixing screw 22, the rotational moment is absorbed to the body 41, so that the head holding unit 42 is barely affected by the rotational moment. As a result, the relative position between the recording heads 18 fixed to the head holding unit 42 is barely deviated.

Furthermore, the invention is not limited to the above-described embodiment, but may be modified into various forms on the basis of the description of the claims.

Next, a second embodiment of the invention will be described.

Figure 19:
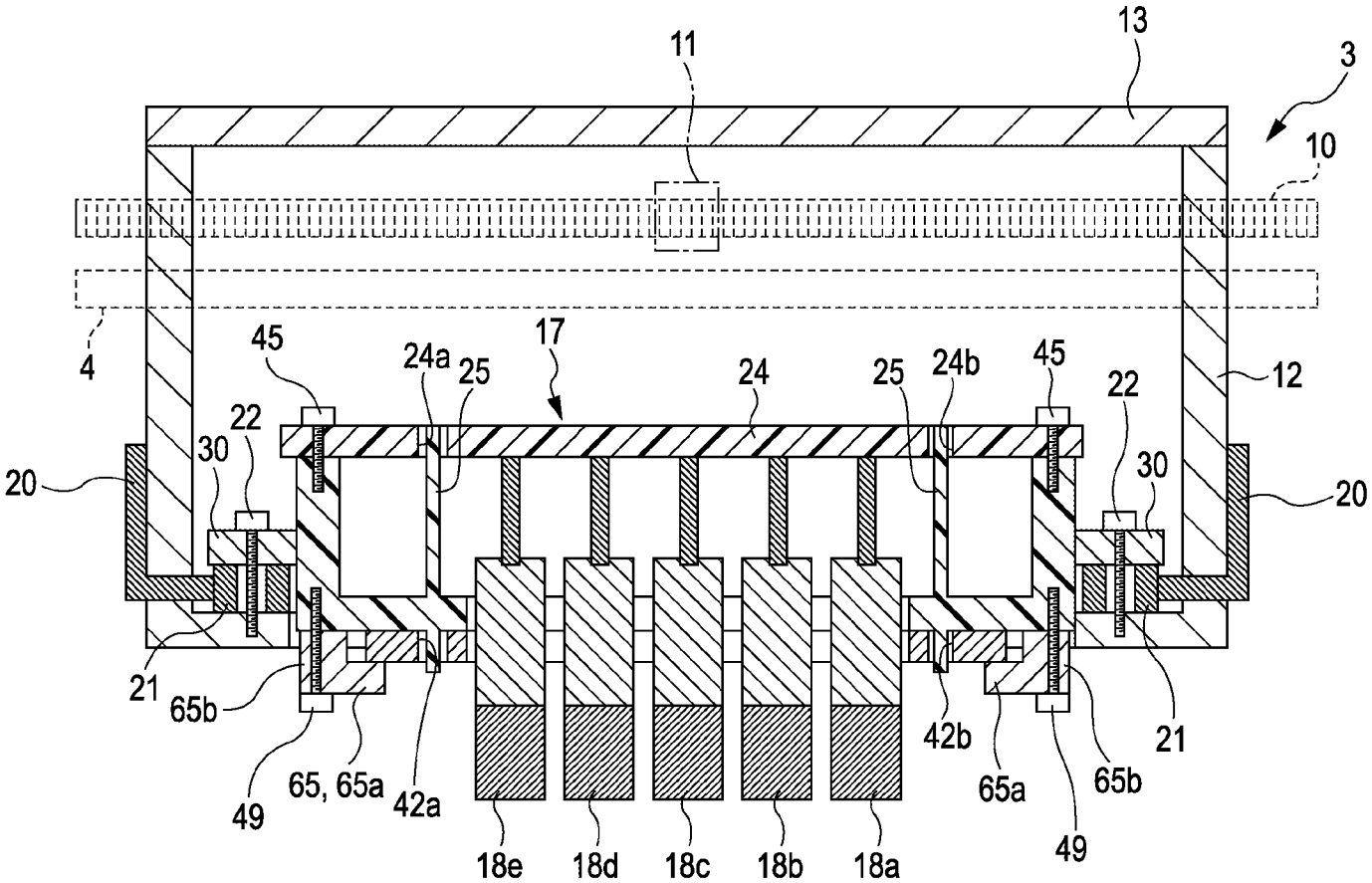
FIG. 19 is a cross-sectional view illustrating a configuration of a carriage assembly according to a second embodiment.
Figure 20:
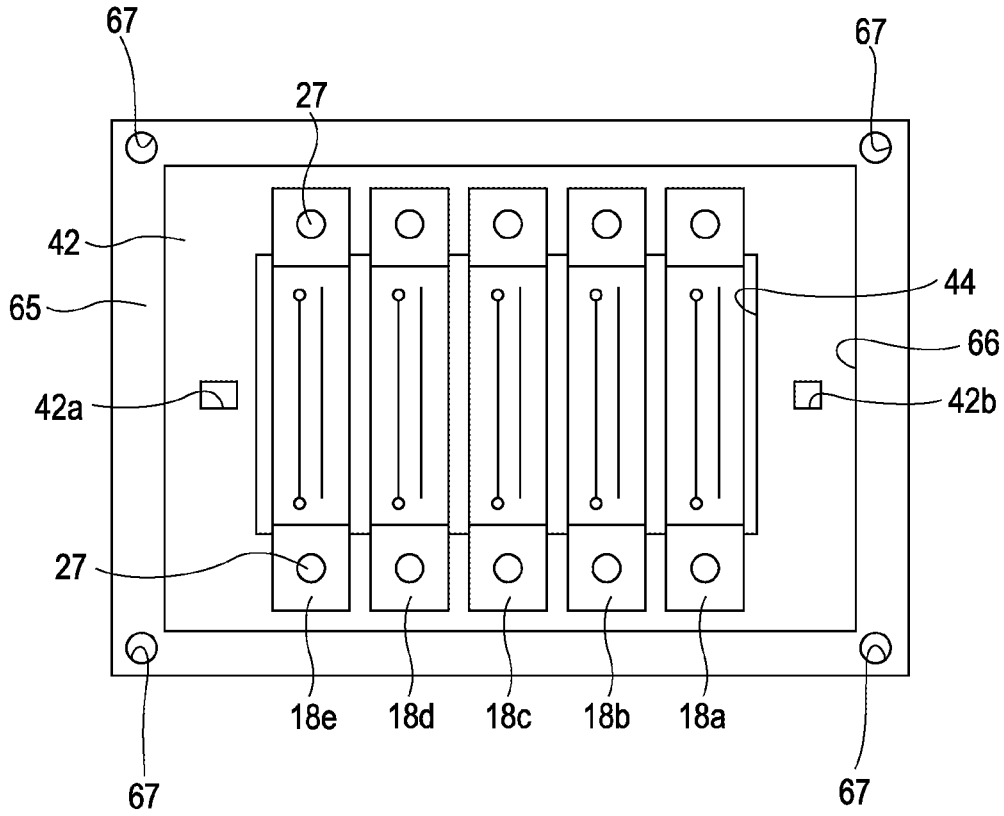
FIG. 20 is a bottom view illustrating a head holding unit which is attached to a support frame.

FIG. 19 is a cross-sectional view simply illustrating a configuration of the carriage assembly 3 according to the second embodiment. Further, FIG. 20 is a bottom view illustrating the head holding unit 42 which is attached to a support frame 65. In the embodiment, the method of fixing the head holding unit 42 to the body 41 is different from that of the first embodiment. Since the other configurations are the same as those of the first embodiment, the specific description thereof will be omitted.

In the above-described first embodiment, the head holding unit 42 is disposed on the upper surface of the base portion 41*a* of the body 41 to be directly screw-fixed to the body 41 by the holding unit threading screw 49. However, the head holding unit 42 of the embodiment is disposed at the lower surface of the base portion 41*a* of the body 41 so as to be indirectly fixed to the body 41 by the support frame 65 (corresponding to a fixing unit of the invention). The support frame 65 includes a frame portion 65*a* and support wall portions 65*b* uprightly formed upward from the outer peripheral edges of the four sides of the frame portion 65*a* (toward the body 41 in the attachment state), and is made of, for example, metal or a synthetic resin. Furthermore, the shape or the like of the support frame 65 is not limited to the example.

The dimensions of the frame portion 65*a* in the lengthwise and widthwise directions are set to be larger than the dimensions of the head holding unit 42 in the corresponding directions. Further, a rectangular frame opening 66 is provided at the approximate center of the frame portion 65*a* so as to insert the plurality of recording heads 18 fixed to the head holding unit 42 therethrough. The dimensions of the frame opening 66 in the lengthwise and widthwise directions are set to be slightly smaller than those of the head holding unit 42 in the corresponding directions. Further, a support frame insertion hole 67 is provided at four corners of the frame portion 65*a* so as to correspond to each of the four fixing holes 47 of the base portion 41*a* of the body 41.

The protrusion length of the support wall portion 65*b* from the upper surface (the surface where the head holding unit 42 is disposed) of the frame portion 65*a* is set to be equal to or slightly smaller than the thickness of the head holding unit 42. Further, the head holding unit 42 having the recording head 18 fixed thereto is accommodated in a space surrounded by the upper surface of the frame portion 65*a* and the upright wall portions 41*b*, and is supported by the frame portion 65*a* and the upright wall portions 41*b*. In this state, a part of the frame portion 65*a* overlaps with the outer peripheral edge of the head holding unit 42 in the plan view. Further, the positioning pins 25 protruding from the lower surface of the body 41 are respectively inserted through the holding portion positioning holes 42*a* and 42*b* near the head holding unit 42. Further, in the state where the position of the head holding unit 42 with respect to the base portion 41*a* is defined and the head holding unit 42 is interposed between the body 41 and the support frame, the holding unit threading screw 49 is screw-fixed to the fixing hole 47 of the body 41 via the support frame insertion hole 67, so that the support frame 65 is fixed to the body 41. By fastening the holding unit threading screw 49, the head holding unit 42 adheres to the body 41. Accordingly, the head holding unit 42 is fixed to the body 41 via the support frame 65. In this manner, the rotational moment generated when fastening the holding unit threading screw 49 barely affects the head holding unit 42 by adopting a configuration in which the head holding unit 42 is fixed to the body 41 via the support frame 65. As a result, the relative position between the recording heads 18 fixed to the head holding unit 42 may be more reliably prevented from being deviated.

Furthermore, in the above-described embodiments, a configuration has been adopted in which an ink is ejected while the recording head 18 is moved in a reciprocating manner with respect to the recording medium, but the invention is not limited thereto. For example, a configuration may be adopted in which an ink is ejected while the recording medium is moved with respect to the recording head 18 while the position of the recording head 18 is fixed.

Further, in the above-described embodiments, the ink jet printer 1 as a type of liquid ejecting apparatus has been exemplified, but the invention may also be applied to a liquid ejecting apparatus that ejects a liquid by using a plurality of ejecting driving pulses. For example, the invention may be applied to a display manufacturing apparatus manufacturing a color filter such as a liquid crystal display, an electrode manufacturing apparatus manufacturing an electrode such as an organic EL (Electro Luminescence) display or an FED (Field-Emission Display), a chip manufacturing apparatus manufacturing a biochip (a biological element), and a micro pipette accurately supplying a minute amount of a sample solution.

What is claimed is:

1. A liquid ejecting head unit comprising:

a liquid ejecting head which includes a nozzle ejecting a liquid; and a head fixing member to which a plurality of the liquid ejecting heads is positioned and fixed, wherein the head fixing member includes a head holding unit to which the liquid ejecting head is fixed and a body to which the head holding unit is fixed, and wherein the rigidity of the body is lower than that of the head holding unit and the specific weight of the body is smaller than that of the head holding unit.

2. The liquid ejecting head unit according to claim 1, wherein the head holding unit and the body are positioned with respect to each other by fitting a positioning pin provided in one of the head holding unit and the body into a positioning hole provided in the other thereof.

3. The liquid ejecting head unit according to claim 2, further comprising:

a passage member which has a passage provided therein to supply the liquid to the liquid ejecting head, wherein the passage member is fixed to the body.

4. The liquid ejecting head unit according to claim 3, wherein the passage member includes a passage positioning hole corresponding to the positioning pin, and is positioned with respect to the body by fitting the positioning pin into the passage positioning hole.

5. The liquid ejecting head unit according to claim 1, further comprising:

a fixing unit which fixes the head holding unit to the body, wherein the fixing unit is fixed to the body with the head holding unit interposed between the body and the fixing unit.

6. A liquid ejecting apparatus comprising:

a liquid ejecting head unit which includes a liquid ejecting head including a nozzle ejecting a liquid and a head fixing member making a plurality of the liquid ejecting heads be positioned and fixed thereto, wherein the head fixing member includes a head holding unit to which the liquid ejecting head is fixed and a body to which the head holding unit is fixed, and wherein the rigidity of the body is lower than that of the head holding unit and the specific weight of the body is smaller than that of the head holding unit.

7. The liquid ejecting apparatus according to claim 6, further comprising:

a unit holding unit which holds the liquid ejecting head unit, wherein the body of the head fixing member of the liquid ejecting head unit is fixed to the unit holding unit with a position adjusting mechanism capable of adjusting the disposition position of the liquid ejecting head unit with respect to the unit holding unit interposed therebetween, and wherein the head holding unit of the head fixing member is detachably fixed to the body while the body is fixed to the unit holding unit.

* * * * *